United States Patent [19]

Slocum et al.

[11] Patent Number: 4,838,145

[45] Date of Patent: Jun. 13, 1989

[54] MULTIPLE ACTUATOR HYDRAULIC SYSTEM AND ROTARY CONTROL VALVE THEREFOR

[75] Inventors: Alexander H. Slocum, McLean, Va.; James P. Peris, Germantown, Md.

[73] Assignee: The United States of America as represented by the Secretary of Commerce, Washington, D.C.

[21] Appl. No.: 63,558

[22] Filed: Jun. 18, 1987

[51] Int. Cl.[4] ..... F15B 11/00; F15B 13/00

[52] U.S. Cl. ..... 91/536; 91/466; 137/625.23; 137/625.24

[58] Field of Search ..... 91/35, 36, 536, 466; 137/625.23, 625.24; 269/20

[56] References Cited

U.S. PATENT DOCUMENTS

| | | | |
|---|---|---|---|
| 2,384,318 | 9/1945 | Bleu | 91/536 |
| 2,878,786 | 3/1959 | Vuillemin | 91/536 |
| 2,960,073 | 11/1960 | Roxburgh | 137/625.23 |
| 3,021,869 | 2/1962 | Ross | 137/625.24 |
| 3,035,549 | 5/1962 | Hewitt | 91/536 |
| 3,134,403 | 5/1964 | Rudelick | 137/625.23 |
| 3,502,110 | 3/1970 | Ogilvie | 137/625.24 |
| 3,504,703 | 4/1970 | Bozoyan | 137/625.23 |
| 3,650,295 | 3/1972 | Smith | 137/625.24 |
| 3,705,631 | 12/1972 | Seaberg | 91/536 |
| 4,177,834 | 12/1979 | Bonney | 137/625.23 |
| 4,308,892 | 1/1982 | Van Ausdal | 137/625.24 |
| 4,311,171 | 1/1982 | Roberts | 137/625.24 |
| 4,499,922 | 2/1985 | Tanguy | 137/625.24 |
| 4,558,720 | 12/1985 | Larson et al. | 137/625.24 |

*Primary Examiner*—Robert E. Garrett

*Assistant Examiner*—Thomas Denion

*Attorney, Agent, or Firm*—Thomas Zack; Alvin Englert; Mitchell W. Shapiro

[57] ABSTRACT

A hydraulic system has a rotary valve which controls multiple hydraulic devices such as double-acting piston type actuators and which prevents deactivated devices from creeping. The valve has an outer housing and a rotatable inner member which form high pressure inlet, low pressure outlet, and control stages. The control stages utilize partial commutators (part circumferential grooves) and ports on the valve member selectively to couple control ports of the housing respectively to the inlet stage or the outlet stage by rotating the inner valve member (the control ports being connected to the hydraulic devices). At the inlet and outlet stages, the valve member has full annular commutators which communicate continuously with a high pressure inlet port and a low pressure vent port of the housing as the valve member is rotated. The valve member also has internal passageways which connect each control stage partial commutator and fluid port to either the inlet commutator or the outlet commutator. The control stages are arranged such that control ports not selected for coupling to the inlet stage will be coupled to the outlet stage and therefore vented to low pressure. This prevents any high pressure fluid leakage within the valve from flowing to non-selected devices, which therefore cannot creep. Thrust loads on the rotatable valve member are prevented by porting the inner end of the valve member to the outlet commutator in order to vent fluid from the closed inner end of the housing.

36 Claims, 3 Drawing Sheets

MULTIPLE ACTUATOR HYDRAULIC SYSTEM AND ROTARY CONTROL VALVE THEREFOR

BACKGROUND OF THE INVENTION

This invention relates generally to hydraulic systems and controls and is more particularly concerned with a rotary control valve for simultaneously controlling fluid distribution to a plurality of hydraulically actuated devices (e.g., piston-type actuators) and with a system incorporating such a valve.

The invention is especially useful in connection with hydraulic actuator arrays for use in parts fixtures, such as vises, for machine tools. These parts fixtures may, for example, utilize hydraulically controlled mechanical stops to establish the proper position of a workpiece for machining. The stops may be actuated manually or, in the case of computer-controlled systems, automatically.

Electrically operated solenoid valves are among the most reliable means of automatic actuation currently in commercial use. Solenoid valves offer the advantage of being substantially leakage-free since constant pressure is maintained on the valve seal. However, a single solenoid valve is only useful to control one actuator in the ordinary case. Solenoid valves also tend to make hydraulic control systems bulky and impractical, especially when complex valving arrangements are involved.

Rotary valves provide an alternative to solenoid valves but have likewise been of only limited utility, due particularly to problems associated with internal leakage (which causes actuator creep), control logic complexity, and equipment size limitations, among other factors. U.S. Pat. No. 3,021,869 issued Feb. 20, 1962 to Ross is exemplary in this regard. Ross discloses a rotary valve for controlling a double acting hydraulic piston. The valve has a hollow cylindrical casing with four fluid ports: a supply port positioned at one end of the casing and connected to receive fluid pumped from a reservoir, two load ports aligned longitudinally of the casing with the supply port and connected to opposite sides of the piston housing, and a reservoir port disposed between the load ports and connected to the reservoir. The valve casing houses a rotary plug with internal passages that may be brought into alignment with the various casing ports to control fluid flow to and from the opposite sides of the piston housing. Circumferential ring seals on the valve plug seal with the valve casing between each load port and the reservoir port.

As the ring seals in the Ross valve wear during use, internal leakage of high pressure fluid to the load ports develops and causes the piston to creep. Hydraulic engineers often avoid rotary valves for this reason alone. Additionally, however, because the Ross valve requires three discrete positions to control a single piston, modification to accommodate more than one piston would complicate the valve structure considerably and could lead to logic error conditions in which a piston (or pistons) is improperly extended or retracted. The Ross valve suffers from yet another drawback in that a large thrust bearing is necessary in practice to support the valve plug within the casing. More particularly, because the valve plug is made shorter than the casing so as to provide a fluid supply chamber at one end of the casing, the plug will experience high thrust loads due to the pressure of the supply fluid, thus necessitating a thrust bearing of substantial construction.

Due to the above-discussed and other problems related to hydraulic control, the automation of parts fixtures has remained impractical for the vast majority of machine shops.

SUMMARY OF THE INVENTION

The present invention provides a rotary hydraulic valve and a multiple hydraulic actuator system which, together, offer a truly practical solution to the problem of automating machine-tool parts fixtures. The control valve of the invention is capable of carrying out the complex logic required for multiple actuator control but is nonetheless both simple and compact. The actuator system is designed to incorporate a rotary valve but avoids the problem of creep which is characteristic of prior rotary-valve controlled actuators. As will be seen hereinafter, the valve design of the invention also prevents thrust loads on the rotary valve member and thus avoids the need for heavy duty thrust bearings—even in high pressure applications.

The present invention stems largely from the recognition that rotary valves will always exhibit internal leakage and that the problem of actuator creep may be overcome by always venting the positive side (activation chamber) of non-activated actuators to low pressure. By venting the activation chamber of each non-activated (non-selected) actuator to low pressure, even if high pressure fluid should leak internally of the valve to the corresponding actuator control port, fluid pressure cannot build up in the actuator's activation chamber. Therefore, the actuator cannot creep.

Thus, in one of its broad aspects, the invention provides a hydraulic system comprising a plurality of hydraulically operated devices and a rotary hydraulic valve for controlling fluid distribution to the respective activation chambers of the devices. The valve includes a housing and a valve member rotatably received within the housing and having an outer surface proximate an inner wall of the housing. The housing has high pressure fluid inlet means, low pressure fluid outlet means, and a plurality of control ports each connected to the activation chamber of a corresponding hydraulically operated device. The valve member has high pressure fluid distribution means in communication with the high pressure fluid inlet means for distributing high pressure fluid to the control ports. The valve member further has low pressure fluid vent means in communication with the low pressure fluid outlet of the housing for venting the control ports to the low pressure outlet. The distribution means and the vent means are arranged such that the former may be positioned by rotation of the valve member to communicate with the control ports selectively, with the vent means simultaneously communicating with non-selected control ports. The valve is thereby operable to distribute high pressure fluid selectively to the activation chambers of the hydraulically operated devices and simultaneously to vent the activation chambers of non-selected devices to low pressure.

In another of its broad aspects, the invention provides a rotary control valve which implements the control logic of the foregoing system. The invention achieves a simple and compact valve construction through the use of so-called "commutators." In hydraulic applications, a commutator is a ported annular groove, usually formed on a shaft and communicating with an adjacent port or ports in a surrounding housing (or, conversely, formed in the housing and communicating with a port or ports in the shaft). During relative rotation of the shaft and housing, the commutator provides continuous fluid communication between the adjacent housing port and any part of the shaft which is connected to the commutator (that is, any port which is connected to the ported annular groove—as, for example, by a passageway within the shaft).

More particularly, a rotary valve in accordance with the invention may comprise a housing having fluid inlet means, fluid outlet means, and a plurality of peripherally spaced control ports situated substantially at a plane, and a valve member supported in the housing for rotation on an axis transverse to the plane of the control ports and having an outer surface proximate an inner wall of the housing. The valve member includes a partial fluid commutator extending substantially about its periphery and disposed for communication with the control ports, and a peripheral fluid port spaced from the partial fluid commutator and also disposed for communication with the control ports. The partial commutator and the peripheral fluid port are arranged such that by rotation of the valve member on the rotation axis, the fluid port may be positioned to communicate with the control ports selectively, with the partial fluid commutator simultaneously communicating with non-selected control ports. The valve member further includes a first internal fluid passageway in communication with the partial fluid commutator and one of the fluid inlet and fluid outlet of the housing, and a second internal fluid passageway in communication with the peripheral fluid port and the other of the fluid inlet and fluid outlet of the housing.

Finally, in accordance with that aspect of the invention relating to the elimination of thrust forces, a rotary valve structure may include a housing having a cavity which is closed at one end and a high pressure fluid inlet, a low pressure fluid vent, and a control port all in communication with the cavity. A valve member is rotatably received within the housing with an outer surface of the valve member being proximate an inner wall of the housing, the valve member having an internal high pressure fluid path running between the inlet and the control port of the housing. The valve member also has an internal fluid vent path running from the closed end of the housing to the low pressure vent of the housing in order to vent fluid under pressure from the closed end of the housing and thereby avoid the generation of thrust forces on the valve body.

The various features and advantages of the invention will be more fully apparent from the following description of the preferred embodiments taken in conjunction with the accompanying drawings.

DESCRIPTION OF THE PREFERRED EMBODIMENTS

Figure 1:
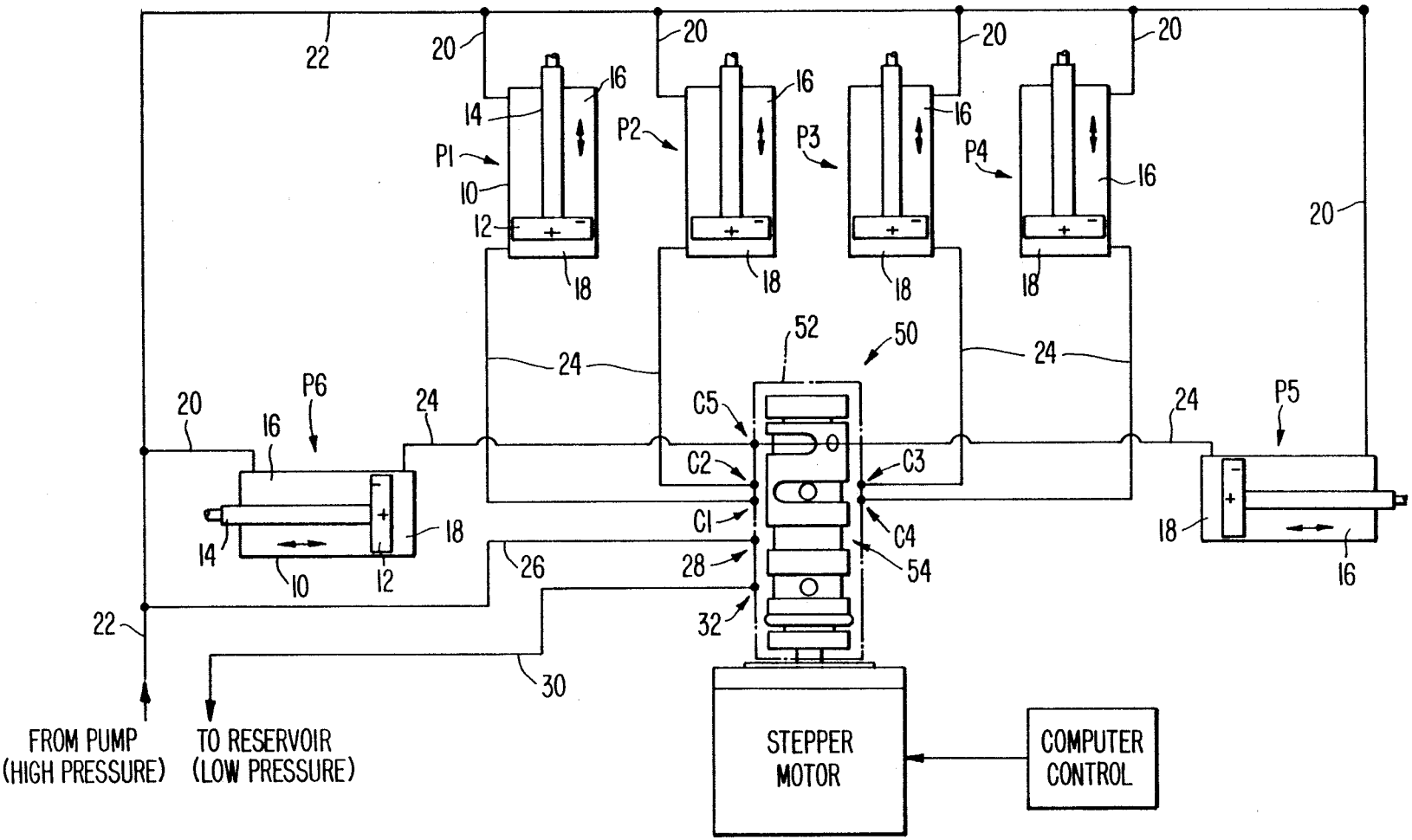
FIG. 1 is a schematic diagram of a multiple actuator hydraulic system in accordance with the invention.

FIG. 1 shows an exemplary multiple hydraulic actuator system in accordance with the invention. The illustrative system includes six double-acting piston type hydraulic actuators P1–P6 and a single rotary hydraulic control valve 50 for controlling all six actuators. Valve 50 includes a housing 52, outlined in dot-dash lines in FIG. 1, and a rotary valve member 54 rotatably received within the housing. The special design of a housing 52 and valve member 54 which enables the valve simultaneously to control the actuators will be described later. Double-acting piston actuators are, of course, well known in the art, but a brief description of actuators P1–P6 will now be given in order to facilitate understanding of the invention.

Each actuator P1-P6 includes a cylinder 10, a piston 12 within the cylinder, and a piston rod 14. Piston rod 14 has one end rigidly connected to piston 12 and another end extending outwardly through an end of cylinder 10, as shown. In order to simplify the drawing, the foregoing reference numerals have been shown only for actuators P1 and P6, it being understood that the remaining actuators are of the same basic construction. The side of piston 12 to which piston rod 14 is connected is considered the negative (−) side, and the opposite side of the piston is considered the positive (+) side. Piston 12 divides the interior of cylinder 10 into two chambers, designated 16 and 18. Chamber 18 will be referred to herein as the "activation chamber" for reasons which will become apparent.

As indicated by the double-headed arrows in FIG. 1, piston 12 can be made to move in either direction on the cylinder axis by applying a greater hydraulic force to the piston's positive side than to its negative side or vice versa. When a greater force is applied to the positive side, piston 12 moves toward the negative side and rod 14 is extended from cylinder 12. In FIG. 1, such movement would be upward for actuators P1–P4, rightward for actuator P5, and leftward for actuator P6. Conversely, when a greater force is applied to the negative side of piston 12, the piston will move in the opposite direction, and piston rod 14 will be retracted into cylinder 10. Actuators P1–P6 are all shown in a deactivated state in FIG. 1, with their respective piston rods 14 retracted.

Returning to the illustrative system more generally, chamber 16 of each actuator is connected to a high pressure fluid supply line 22 by way of an associated fluid line 20. Line 22 may be connected to a high pressure pump, as indicated, which draws fluid from a reservoir (not shown), the reservoir being at low pressure. The activation chamber 18 of each actuator is connected by way of an associated fluid line 24 to one of a set of control ports C1–C5 in the rotary valve housing. Valve 50 is also connected to the high pressure supply line 22 through a high pressure fluid input line 26, which connects to a port 28 in housing 52, and to the fluid reservoir through an output or vent line 30, which connects to an output or vent port 32 in valve housing 52. Rotary valve member 54 and valve housing 52 are designed selectively to connect activation chambers 18 to the high pressure line 26 or the low pressure line 30 by adjustment of the rotational position of valve member 54 within housing 52.

When an activation chamber 18 is connected to the high pressure supply through valve 50, the chambers 16 and 18 of the corresponding actuator are subjected to equal hydraulic pressure. However, because the surface area of the positive side of piston 12 is greater than that of the negative side (due to the connection to piston rod 14), the effective force will be greater on the positive side. The piston will therefore move in a direction to extend piston rod 14 from cylinder 10. Alternatively, when activation chamber 18 is vented to low pressure by valve 50, the force will be greater on the negative side of piston 12, and the piston will move to retract rod 14 into cylinder 10.

Which activation chamber or chambers 18 are connected to high pressure at any time will, of course, depend on the particular control logic scheme designed into valve 50. The illustrative valve is designed to effect a suitable logic scheme for the multiple actuator system of a vise jaw, as disclosed in our copending U.S. patent application Ser. No. 747,486 filed June 21, 1985 (now U.S. Pat. No. 4,685,661 issued Aug. 11, 1987), incorporated herein by reference. In that system, four actuators, say P1–P4, are mounted inside a vise jaw body (basically, a monolithic metal block), just behind a workpiece contacting face of the jaw. The jaw face has openings through which the piston rods of the four actuators may be selectively extended. An extended rod serves as stop member against which a workpiece (a piece to be worked by a machine tool associated with the vise) may be positioned. The remaining two actuators, say P5 and P6, are mounted in opposite sides of the jaw body such that their respective piston rods 14 may be extended laterally of the jaw body in order to hold down replaceable jaw elements which enshroud the jaw body. Rotary valve 50 may also be mounted in the jaw body, which would then serve as valve housing 52. The jaw body would be drilled as necessary to provide the required fluid lines and ports to connect the valve to the high pressure fluid supply, the low pressure fluid reservoir, and the actuator activation chambers 18.

TABLE I summarizes a suitable control logic scheme for the actuator system just described. The logic scheme involves 6 operating phases designated A–F and contemplates at most only one stop actuator P1–P4 being activated (piston rod extended) at any time, with the hold-down actuators being operated jointly and activated whenever a stop actuator is "on." Following TABLE I, the construction of valve 50 which effectuates the illustrative control logic scheme will be described in detail.

TABLE I

| Operating Phase | Group 1--Stop Actuators P1 | P2 | P3 | P4 | Group 2--Hold Down Actuators P5, P6 |
|---|---|---|---|---|---|
| A | — | — | — | — | — |
| B | — | — | — | — | X |
| C | X | — | — | — | X |
| D | — | X | — | — | X |
| E | — | — | X | — | X |
| F | — | — | — | X | X |

"—" = deactivated
"X" = activated

Figure 3:
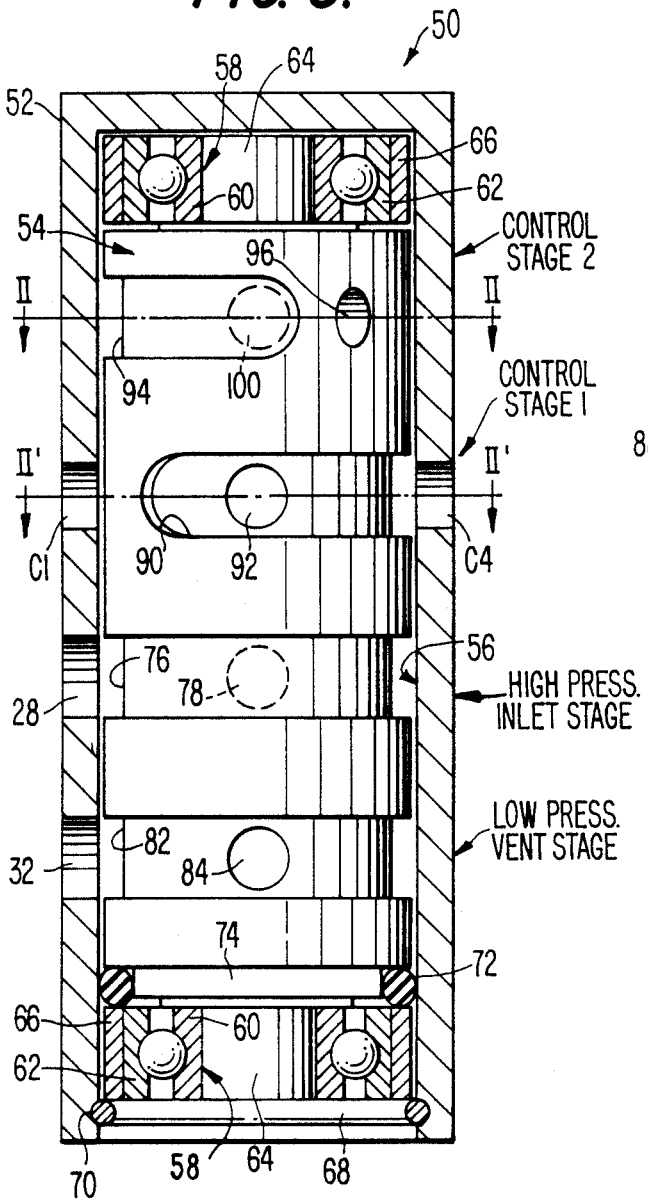
FIG. 3 is a part-sectional side elevation of the valve.

FIG. 3 illustrates the basic construction of rotary control valve 50. In the form shown, valve housing 52 has a cylindrical bore or cavity 56 formed therein. Cavity 50 is closed at one longitudinal end (the upper end in FIG. 3) and open at its opposite longitudinal end (the bottom end in FIG. 3). If housing 52 should be a monolithic block, as in the aforementioned vise jaw, cavity 56 may be formed by drilling into the block from one side. Valve member 54 is generally cylindrical and received within cavity 56 with its circumferential periphery proximate the peripheral wall of the cavity (close tolerance fit, as shown). The longitudinal ends of valve member 54 are formed with trunnions 64 which are rotatably supported by ball bearings 58 such that the valve member may be rotated on its longitudinal axis within cavity 56. More particularly, in the illustrative arrangement, annular inner races 60 of the ball bearings are press-fit over the respective trunnions 64, and annular outer races 62 of the bearings are press-fit into annular spacers 66 which, in turn, are press-fit within cavity 56 of the housing. The valve-member/bearing structure is secured longitudinally within cavity 56 by an abutting split snap-ring 68 which resiliently snaps into a complementary circumferential groove 70 formed at the open end of the housing. The valve assembly is sealed by a ring seal 72 carried on a stepped portion 74 of valve member 54. Ring seal 72 maintains sealing engagement with the valve member and the peripheral wall of cavity 56 as the valve member rotates within the cavity. As will be explained later, ring seal 72 is not subjected to high fluid pressure and thereby avoids the high friction ordinarily associated with pressurized ring-type seals. This minimizes the torque required to turn valve member 54, as well as leakage from cavity 56.

Turning now to the fluid control aspects, valve 50 is constructed to accomplish three principal objectives:

1. To execute the control logic illustrated in TABLE I;
2. To prevent creep of the respective actuators P1–P6 when they are deactivated (i.e., when piston rod 14 is to be held retracted); and
3. To prevent thrust loading of valve member 54.

To these ends, valve 50 is designed with four stages, including two control stages, a high pressure inlet stage, and a low pressure outlet or vent stage (see FIG. 3). The four stages are spaced longitudinally of the valve assembly, with the high pressure inlet stage being located intermediate the low pressure vent stage to one side toward the open end of cavity 56, and the two control stages to the other side toward the closed end of cavity 56. These stages will now be described.

At the high pressure inlet stage, valve 50 receives high pressure fluid via a port 28 in housing 52. In the system of FIG. 1, the high pressure fluid is supplied by way of fluid line 26 which runs between port 28 and high pressure supply line 22. Valve member 54 has an annular commutator groove 76 extending about the entire valve-member circumference, in alignment with port 28. Thus, the high pressure fluid introduced through port 28 will enter the annular channel space defined by commutator 76, regardless of the rotational position of valve member 54 within housing 52. Because of the close tolerance fit between the valve member and the inner periphery of the valve housing, any leakage internally of the valve housing from commutator 76 will be minimal.

Figure 4:
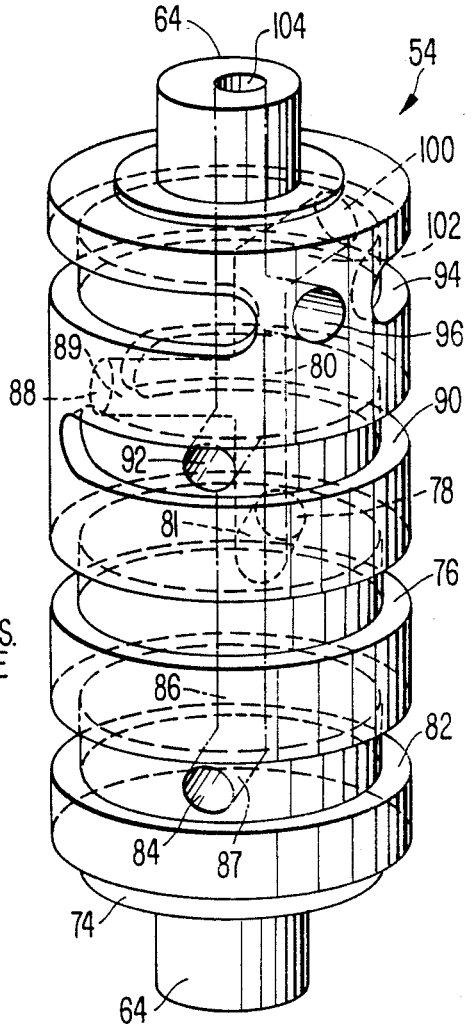
FIG. 4 is a perspective view of the rotary valve element, depicting the internal fluid passages of the element.

Commutator 76 is ported at 78 to an internal passageway 81 which branches off laterally from an eccentric longitudinal passageway 80 formed internally of valve member 54. The passageway 80 and branch passageway 81 connecting it to port 78 are best seen in FIG. 4. Passageway 80 may be formed, for example, by boring out a longitudinal segment of the valve member from one end and then sealing off that end, as with a barbed metal plug (not shown). Port 78 and branch passageway 81 may be formed by drilling inward from the base of commutator 76 into passageway 80.

The low pressure vent stage of valve 50 is formed similarly to the high pressure inlet stage, but is used instead to vent fluid from the valve to low pressure. More particularly, the low pressure stage includes a vent port 32 through valve housing 52 and a full annular commutator 82 formed in valve member 54 and aligned with vent port 32. Commutator 82 is ported at 84 to a passageway 87 which branches off laterally from a second eccentric longitudinal passageway 86 in valve member 54, as is best seen in FIG. 4.

Figure 2:
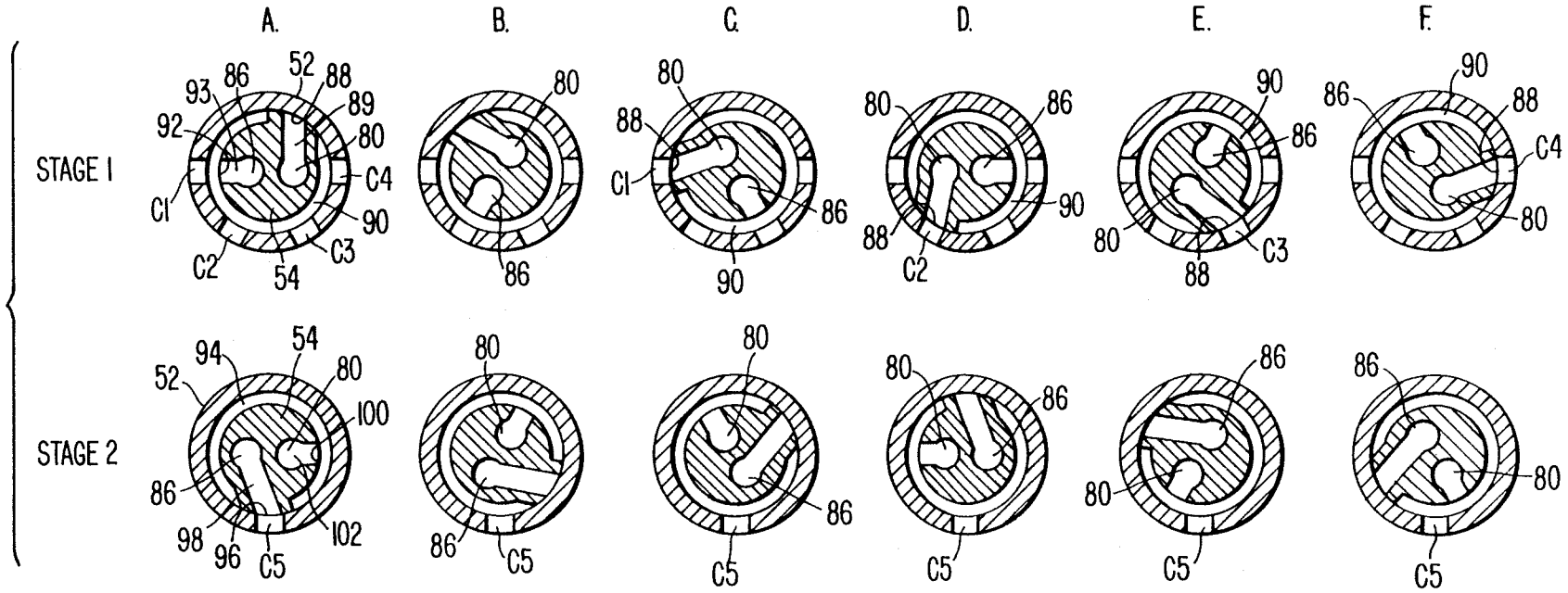
FIG. 2 shows cross-sectional views of the two control stages of the rotary valve in the system of FIG. 1, the views being taken respectively along lines II—II and II'—II' in FIG. 3.

Control stage 1 is designed to effect the control logic for actuators P1–P4 in the system of FIG. 1, the various control phases of this stage which correspond to phases A–F in TABLE I being shown in FIG. 2. At control stage 1, valve housing 52 includes the earlier mentioned control ports C1–C4. In the form shown, these control ports are spaced circumferentially of cavity 56 and are situated asymmetrically to one side of the housing at a plane perpendicular to the longitudinal axis of valve member 54 (see FIG. 2). At this same plane, valve member 54 has a high pressure fluid port 88 and a part-annular commutator (partial commutator) 90 which extends about a major circumferential portion of the valve member and which terminates at two ends just short of high pressure port 88. Port 88 is in communication with longitudinal passageway 80 through a branch passageway 89 extending laterally from passageway 80. Partial commutator 90 is ported at 92 to a branch passageway 93 extending laterally from the low pressure longitudinal passageway 86.

When one of actuators P1–P4 is to be activated (its piston rod 14 extended), valve member 54 is rotated to bring port 88 into communication with the control port for the selected actuator. High pressure fluid will then be distributed to the activation chamber of the selected actuator by way of port 28, commutator 76, port 78, internal valve member passageways 81, 80 and 89, port 88, and the selected control port of housing 52. At the same time, the remaining, non-selected control ports of stage 1 will be aligned with partial commutator 90, as shown in phases C–F in FIG. 2. The non-selected control ports are therefore vented to low pressure outlet port 32 by way of partial commutator 90, port 92, internal valve member passageways 93, 86 and 87, port 84, and commutator 82. As a result, the activation chambers 18 connected to the vented control ports are also vented to low pressure. The corresponding non-selected actuators then have high pressure fluid in their respective chambers 16 and low pressure fluid in their respective chambers 18—that is, they are deactivated (piston rods retracted).

In addition to its role in executing the control logic of control stage 1, partial commutator 90 also has a second major purpose: preventing creep of non-selected actuators due to high pressure fluid leakage within valve 50. In particular, because the partial commutator vents all non-selected stage-1 control ports to low pressure vent port 32, any high pressure fluid leakage that may reach a non-selected control port will flow to and out of the vent port rather than to the actuator activation chamber 18 connected to the control port (the path to the vent port having far less resistance to fluid flow than the path to the activation chamber since piston 12 is held under pressure by the high pressure fluid in chamber 16). Consequently, fluid pressure cannot build up in the activation chamber, and the non-selected actuator cannot creep (piston rod remains fully retracted).

Control stage 2 of valve 50 is designed in accordance with the same principles embodied in control stage 1. In this stage, valve housing 52 has the single control port C5 to which both of actuators P5 and P6 are connected. As in control stage 1, valve member 54 has a partial commutator 94 formed at a plane perpendicular to the valve member rotation axis and a fluid port 96 circumferentially spaced from the ends of the partial commutator. However, in order to accomplish the previously specified control logic scheme for stage 2 (see TABLE I), the roles of the partial commutator and fluid port are reversed from those of stage 1. More specifically, fluid port 96 is in communication with low pressure passageway 86 by way of a lateral branch passageway 98, and partial commutator 94 is ported at 100 to a branch passageway 102 extending laterally from high pressure passageway 80.

As will be appreciated from FIG. 2, control port C5, partial commutator 94, and fluid port 96 are arranged such that whenever valve member 54 is rotated to activate one of actuators P1–P4, the stage 2 partial commutator 94 will align with control port C5, thereby activating actuators P5 and P6 with high pressure fluid (control phases C–F). Additionally, the arrangement permits actuators P5 and P6 to be deactivated or activated selectively if none of actuators P1–P4 is activated (control phases A and B).

The features of valve 50 which avoid thrust loading of valve member 54 will now be described. Thrust loads, of course, are developed when fluid pressure at one longitudinal end of the valve member is greater than that at the other end.

Referring to FIG. 4, longitudinal low pressure passageway 86 in valve member 54 terminates at a port 104 in the top surface of trunnion 64 at the closed end of the valve housing. Port 104 vents to port 32 any high pressure fluid which may leak internally of the valve to the closed end of the housing. Such venting is by way of passageway 86, branch passageway 87, port 84, and commutator 82. By venting the closed end of housing 52 through the valve member, thrust forces which would tend to push the valve member out of the open end of the housing are substantially eliminated. In practice, a small thrust force will be exerted on the valve member by fluid present at the closed end of the housing, but bearings 58 and snap ring 68 provide sufficient thrust bearing capability to support such loads. There will not, of course, be any thrust forces directed in toward the closed housing end since the outer end of valve member 54 is not exposed to any fluid under pressure, the high pressure fluid instead being introduced intermediately of the valve by way of commutator 76.

As was briefly mentioned earlier, ring seal 72 is also protected against exposure to the high pressure fluid by virtue of the location of the low pressure vent stage. Specifically, because the low pressure vent stage is situated longitudinally outward of cavity 56 from all high pressure ports of the valve, any leakage of high pressure fluid toward the open end of cavity 56 will simply be vented through port 32 when reaching the low pressure vent stage. Seal 72, thus being at low pressure, has only slight friction against housing 52, and this facilitates rotation of the valve member.

In a practical application of the valve, high pressure fluid distribution ports 88 and 100 may be $\frac{1}{4}$ inch in diameter, and valve member 54 may be nominally 1 inch in diameter. If the high pressure fluid issues from ports 88 and 100 at 2,000 psi, there will be a net radial force of 200 lbs. on the valve member. With the valve member supported by ball bearings, as shown, the torque required to turn it when the valve is pressurized would be only about 0.7 in.-lb. (By contrast, sleeve bearings, which may be used but which are not preferred, would require about 9 in.-lb.) This low torque, together with the minimal thrust loading of the valve member, makes it possible to drive valve member 54 with a small, inexpensive stepper motor, as shown in FIG. 1. The rotation of the stepper motor can be precisely controlled by a computer, thus rendering the valve and the associated multiple actuator system fully automatic. In a vise jaw according to our earlier mentioned co-pending application, the stepper motor could be mounted directly to the jaw, with its shaft keyed to the trunnion 64 at the outer end of cavity 56. The result is a fully automated vise jaw which is compact, simple, and relatively inexpensive.

While preferred embodiments of the invention have been shown and described herein, it will be apparent to those skilled in the art that various changes and modifications can be made in keeping with the principles of the invention, the scope of which is defined in the appended claims. For example, the rotary valve could be designed to implement numerous other control logic schemes such as by changing the control stage configurations and/or the number of control stages. Also, the valve could be used to control other types of actuators than double-acting pistons. The actuators in the system of FIG. 1 could, for instance, be replaced by other reversible actuators, such as vane actuators, or non-reversible hydraulic devices such as spring-loaded piston actuators or rotary hydraulic motors. Non-reversible devices would have only one fluid chamber (an activation chamber connected to a control port of the valve) and would not utilize a continuous high pressure supply for biasing, as do the piston actuators shown in FIG. 1.

We claim as our invention:

1. A hydraulic system comprising a plurality of hydraulically operated devices, each device having an activation chamber for receiving hydraulic fluid under pressure to operate that device in a first operating direction, and a rotary hydraulic valve including a housing and a valve member rotatably received within said housing and having a radially outer surface proximate an inner wall of said housing, said housing having high pressure fluid inlet means, low pressure fluid outlet means, and a plurality of control ports disposed substantially at a plane transverse to a rotation axis of said valve member and each having a corresponding activation chamber connected thereto by fluid delivery means, said valve member having high pressure fluid distribution means which includes fluid port means formed in said radially outer surfaces of said valve member in communication with said high pressure fluid inlet means of said housing by way of first internal passageway means within said valve member for distributing high pressure fluid to said control ports, said valve member further having low pressure fluid vent means which includes partial fluid commutator means formed in said radially outer surface of said valve member and which is in communication with said low pressure fluid outlet means of said housing by way of second fluid passageway means within said valve member for venting said control ports to said low pressure fluid outlet means of said housing, said fluid port means and said partial fluid commutator means being disposed in circumferentially spaced relationship on said valve member and substantially at said plane such that said fluid port means may be positioned by rotation of said valve member on said rotation axis to align with said control ports selectively, with said partial fluid commutator means simultaneously being in alignment with non-selected control ports, whereby said valve is operable to distribute high pressure fluid selectively to the activation chambers of said devices and simultaneously to vent the activation chambers of non-selected devices to low pressure.

2. A system according to claim 1, wherein each of said hydraulically operated devices has a second chamber for receiving fluid under pressure to operate that device in a second operating direction opposite said first operating direction.

3. A system according to claim 2, wherein said fluid delivery means includes means for continuously supplying high pressure fluid to said second chamber of each hydraulically operated device.

4. A system according to claim 3, wherein each of said hydraulically operated devices comprises a cylinder, a piston disposed for reciprocal movement within said cylinder and dividing said cylinder into two chambers which constitute respectively the activation chamber and the second chamber of that device, and a piston rod having an end received in said second chamber and connected to said piston.

5. A system according to claim 1, wherein said valve member is connected to the shaft of a stepper motor.

6. A system according to claim 5, further including computer means for controlling operation of said stepper motor to effect programmed rotation of said valve member.

7. A system according to claim 1, wherein said control ports are asymmetrically arranged about said housing.

8. A system according to claim 1, wherein said low pressure fluid outlet means of said housing comprises an outlet port through said housing and wherein said second internal passageway means of said valve member is in communication with said outlet port by way of a full annular fluid commutator.

9. A system according to claim 8, wherein said full annular fluid commutator is disposed on the outer surface of said valve member.

10. A system according to claim 7, wherein said high pressure inlet means of said housing comprises an inlet port through said housing and wherein said first internal passageway means of said valve member is in communication with said inlet port by way of a full annular fluid commutator.

11. A system according to claim 10, wherein said full annular fluid commutator is disposed on the outer surface of said valve member.

12. A system according to claim 1, wherein said valve member is cylindrical.

13. A system according to claim 12, wherein said valve member is received within a cylindrical cavity of said housing which is open at one end and closed at another end.

14. A system according to claim 13, wherein said valve member has a vent port near one end of said valve member disposed adjacent said closed end of said cavity, said vent port being in communication internally through said valve member with said low pressure outlet means of said housing, whereby fluid is vented from said closed end of said cavity to prevent the build-up of thrust forces on said end of said valve member.

15. A system according to claim 14, wherein said vent port is in communication with said first internal passageway means of said valve member.

16. A system according to claim 13, wherein said low pressure outlet means of said housing is disposed near an end of said valve member opposite said one end of said valve member.

17. A system according to claim 13, wherein an end of said valve member opposite said one end of said valve member carries a sealing ring in sealing engagement with a peripheral wall of said cavity.

18. A system according to claim 13, wherein said housing is a monolithic body.

19. A system according to claim 12, wherein opposite ends of said valve member are supported within said cavity by roller bearing means.

20. A system according to claim 1, including an additional hydraulically operated device having a respective activation chamber for receiving hydraulic fluid under pressure to operate that device in a first operating direction, and wherein said valve housing has an additional control port spaced from said plane and connected to said activation chamber of said additional device by further fluid delivery means, and wherein said valve member includes additional fluid port formed in said radially outer surface of said valve member and in communication by way of said first internal passageway means with said high pressure fluid inlet means of said housing for distributing high pressure fluid to said additional control port, and additional partial commutator means formed in said radially outer surface of said valve member and in communication by way of said second internal passageway means with said low pressure fluid outlet means of said valve housing for venting said additional control port to said low pressure fluid outlet means of said housing, said additional fluid port means and said additional partial commutator means being arranged so as to be selectively positionable by rotation of said valve member to align with said additional control port.

21. Rotary hydraulic valve apparatus comprising a housing and a valve member supported in said housing for rotation on an axis and having a radially outer surface proximate an inner wall of said housing, said housing having fluid inlet means, fluid outlet means, and a plurality of peripheral spaced control ports disposed substantially at a plane transverse to said rotation axis of said valve member, said valve member including partial fluid commutator means formed in said radially outer surfaces of said valve member and extending substantially about the circumference of said valve member, fluid port means disposed on said radially outer surface of said valve member and spaced circumferentially of said surface from said partial fluid commutator means for communication with said control ports, first internal fluid passageway means disposed within said valve member in communication with said partial fluid commutator means and one of said fluid inlet means and said fluid outlet means, and second internal fluid passageway means disposed within said valve member in communication with said fluid port means and the other of said fluid inlet means and said fluid outlet means, said partial fluid commutator means and said fluid port means being arranged substantially at said plane such that said fluid port means may be positioned by rotation of said valve member on said rotation axis to align with said control ports selectively, with said partial fluid commutator means simultaneously being in alignment with non-selected control ports.

22. Rotary hydraulic valve apparatus according to claim 21, wherein said one of said fluid inlet means and said fluid outlet means comprises a port through said housing and wherein said first internal fluid passageway means includes a fluid passage having one end in communication with said partial fluid commutator means and another end in communication with the last-mentioned port by way of a full annular fluid commutator.

23. Rotary hydraulic valve apparatus according to claim 21, wherein said other of said fluid inlet means and said fluid outlet means comprises a port through said housing and wherein said second internal fluid passageway means includes a fluid passage having one end in communication with said fluid port means and another end in communication with the last-mentioned port by way of a full annular fluid commutator.

24. Rotary hydraulic valve apparatus according to claim 21, wherein said valve member is cylindrical.

25. Rotary hydraulic valve apparatus according to claim 22, wherein said housing includes at least one additional control port disposed at a second plane transverse to said rotation axis and spaced along said axis from said plurality of control ports, said valve member including additional partial fluid commutator means which is formed on said radially outer surface of said valve means and extends substantially about the circumference of said valve member and which is disposed for alignment with said additional control port, additional fluid port means disposed on said radially outer surface of said valve member and spaced circumferentially from said additional partial fluid commutator means for alignment with said additional control port, said additional partial fluid commutator means being in communication with one of said first internal fluid passageway means and said second internal fluid passageway means, and said additional fluid port means being in communication with the other of said first internal passageway means and said second internal passageway means.

26. Rotary hydraulic valve apparatus according to claim 21, wherein said valve member is supported at opposite axial ends within said housing by roller bearing means.

27. Rotary hydraulic valve apparatus according to claim 21, wherein said housing has a cylindrical cavity closed at one end and open at another end, and wherein said valve member is cylindrical and received within said cavity.

28. Rotary hydraulic valve apparatus according to claim 27, wherein an end of said valve member disposed adjacent said closed end of said cavity has a fluid vent port in communication internally through said valve member with said fluid outlet means of said housing.

29. Rotary hydraulic valve apparatus according to claim 27, wherein said housing is a monolithic body.

30. Rotary hydraulic valve apparatus according to claim 21, wherein an end of said valve member adjacent said open end of said cavity carries a sealing ring sealingly engaging a peripheral wall of said cavity.

31. A hydraulic system comprising a plurality of hydraulically operated devices, each device having an activation chamber for receiving hydraulic fluid under pressure to operate that device in a first operating direction and a second chamber for receiving hydraulic fluid under pressure to operate that device in a second operating direction opposite said first operating direction, and a rotary hydraulic valve including a housing and a valve member rotatably received within said housing and having an outer surface proximate an inner wall of said housing, said housing having high pressure fluid inlet means, low pressure fluid outlet means, an a plurality of control ports each having a corresponding activation chamber connected thereto by fluid delivery means, said valve member having high pressure fluid distribution means in communication with said high pressure fluid inlet means of said housing for distributing high pressure fluid to said control ports and having low pressure fluid vent means in communication with said low pressure fluid outlet means of said housing for venting said control ports to said low pressure fluid outlet means of said housing, said distribution means and said vent means being arranged such that said distribution means may be positioned by rotation of said valve member to communicate with said control ports selectively, with said vent means simultaneously communicating non-selected control ports, whereby said valve is operable to distribute high pressure fluid selectively to the activation chambers of said devices and simultaneously to vent the activation chambers of non-selected devices to low pressure, and said fluid delivery means having means for continuously supplying high pressure fluid to said second chamber of each hydraulically operated device.

32. A system according to claim 31, wherein each of said hydraulically operated devices comprises a cylinder, a piston disposed for reciprocal movement within said cylinder and dividing said cylinder into two chambers which constitute respectively the activation chamber and the second chamber of that device, and a piston rod having an end received in said second chamber and connected to said piston.

33. A system according to claim 31, wherein said valve member is connected to the shaft of a stepper motor.

34. A system according to claim 33, further including computer means for controlling operation of said stepper motor to effect programmed rotation of said valve member.

35. A system according to claim 1, wherein said partial fluid commutator means extends around substantially the entire circumferential portion of said valve member adjacent to said fluid port means at said plane.

36. Rotary hydraulic valve apparatus according to claim 21, wherein said partial fluid commutator means extends around substantially the entire circumferential portion of said valve member adjacent to said fluid port means at said plane.

* * * * *